United States Patent [19]

Korger

[11] 4,101,145

[45] Jul. 18, 1978

[54] SKI BRAKE

[75] Inventor: Heinz Korger, Munich, Fed. Rep. of Germany

[73] Assignee: Hannes Marker, Garmisch-Partenkirchen, Fed. Rep. of Germany

[21] Appl. No.: 705,578

[22] Filed: Jul. 15, 1976

[30] Foreign Application Priority Data

Jul. 25, 1975 [DE] Fed. Rep. of Germany ..... 2533470

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,989,271 | 11/1976 | Riedel | 280/605 |
| 3,992,030 | 11/1976 | Salomon | 280/605 |

FOREIGN PATENT DOCUMENTS

| | | | |
|---|---|---|---|
| 134,042 | 7/1933 | Austria | 280/605 |
| 984,272 | 7/1951 | France | 280/605 |

*Primary Examiner*—David M. Mitchell

*Attorney, Agent, or Firm*—Fleit & Jacobson

[57] ABSTRACT

A ski brake comprises two wings which swing to extend laterally from the ski when the latter becomes detached from the ski boot. The wings can swing about a respective pivot on a lever which is itself pivotally connected to a base plate secured to the ski. Confronting extensions of the brake wings each carry a hinge pin and the hinge pins are interconnected by a spring-biassed rod or by the flanged ends of a bending spring. The base plate also pivotally supports a pedal which is articulated to the lever and depressible by the ski boot to retract the brake wings.

9 Claims, 8 Drawing Figures

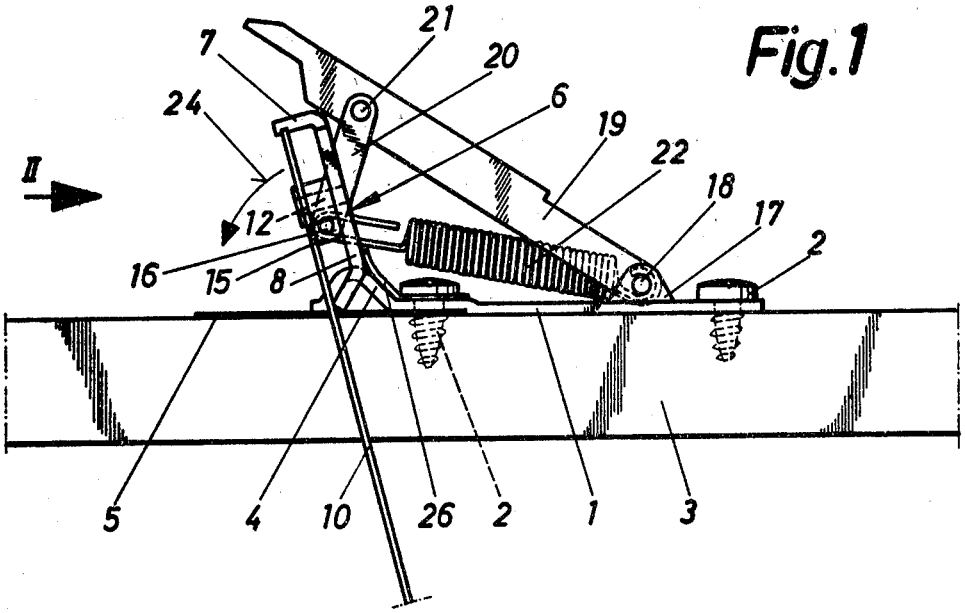
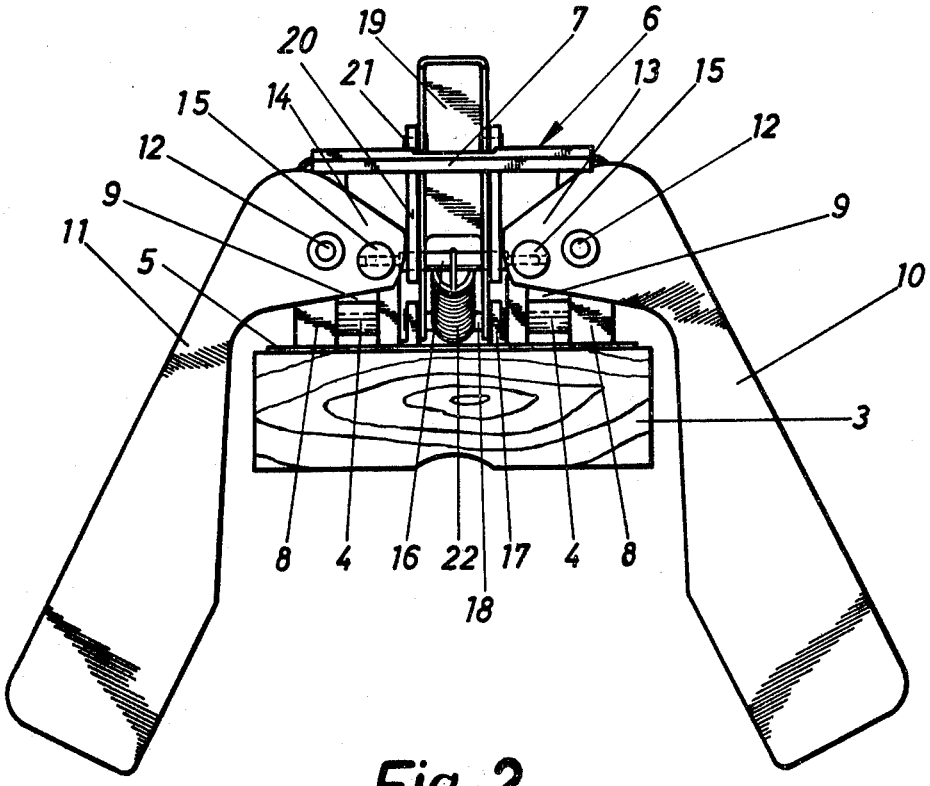
Fig. 2

SKI BRAKE

The present invention relates to a ski brake in the form of a two-armed lever of which the pivot is disposed on the ski surface at least approximately transversely to the length of the ski, one arm being actuatable by a pedal operable by the ski boot and the other arm being divided to form two brake wings disposed beyond the sides of the ski, wherein the ski brake is spring-influenced so that, with the boot removed, it automatically assumes its braking condition whilst in the inoperative condition the two brake wings are disposed above and parallel to the ski surface and pulled towards each other.

In such a known ski brake, the required force for spreading the brake wings and swinging the lever from the inoperative position to the operative braking position is derived from the elastic deformation of a spring wire bow which itself forms the two-armed lever and the pivot pin.

The spring wire bow has the shape of a U of which the central portions of the limbs are flanged outwardly substantially at right-angles and twisted out of the plane of the U. The free ends of the limbs are again flanged substantially at right-angles so that they are slightly splayed and lie in a plane substantially parallel to the plane of the U. These free ends of the limbs are sprayed with a cover of plastics material and constitute the brake wings whilst the adjoining portions form the pivot pin.

Since the parts of the pivot pin are disposed obliquely instead of coaxially, the stress of the spring is increased when the lever is swung to the inoperative position. Subsequent pulling of the brake wings towards one another is effected by displacement of the lever lengthwise of the ski, the pivot pin portions running up inclined faces which are provided on a base plate fixed to the ski and which converge towards the web of the U, this leading to an additional bending load on the limbs of the U. Displacement of the lever lengthwise of the ski is effected by stretching a pedal which is hinged to the base plate and to the web of the U, normally extends at an angle and is depressible by the ski boot.

The primary disadvantage of this ski brake resides in the small extent to which the brake wings can be spread. Thus, the brake wings will offer only a small surface area transversely to the length of the ski so that in the inoperative position of the ski brake the wings will not project too far beyond the sides of the ski and thereby impede skiing. However, a large braking area transversely to the length of the ski is required to bring the ski to a standstill even in loose snow. Another disadvantage of the known ski brake is its short effective life caused by the fact that one and the same length of spring wire is used as a spring as well as the brake wings.

It is an object of the invention to construct and improve a ski brake of the aforementioned kind so that it will offer as large an area as possible transversely to the length of the ski so as to bring the ski to a stop in the shortest possible distance when it is released from the ski boot. Further, the ski brake is to be insensitive and durable without being bulky or crude and expensive.

The invention provides a ski brake in the form of a two-armed lever of which the pivot is disposed on the ski surface at least approximately transversely to the length of the ski, one arm being actuatable by a pedal operable by the ski boot and the other arm being divided to form two brake wings disposed beyond the sides of the ski, wherein the ski brake is spring-influenced so that, with the boot removed, it automatically assumes its braking condition whilst in the operative condition the two brake wings are disposed above and parallel to the ski surface and pulled towards each other, characterised in that each brake wing is pivoted about a pivot to the said one arm that is actuatable by the pedal, the pivot being at right-angles to the said one arm, and that, in addition to being connected to the said one arm, the pedal is connected to the brake wings so that, when said one arm is parallel to the ski surface, the pedal can swing the wings relatively to said one arm.

Such a construction permits the brake wings to be projected far beyond the ski surface to present a wide wing area to the snow and thereby provide effective braking and yet the actuating path to be traversed by the pedal to bring about projection and retraction of the wings is very small.

It has proved advantageous for the pedal to be connected to the said one lever arm by a coupling member. In this case, the coupling member can be connected to the said one lever arm by way of the brake wings.

In a preferred embodiment of the invention, the pedal is mounted on the ski surface parallel to the pivotal axis of the lever. In another embodiment, a steering member on the ski surface is mounted parallel to the pivotal axis of the lever, the pedal being hinged to the free end of the steering member with its axis parallel.

The ski brake can be of shallow and compact construction if the brake wings are extended towards one another beyond their pivot connections to the said one arm, the pedal being connected to these extensions. For this purpose, the extension of each brake wing may carry a hinge pin parallel to its said pivot and the hinge pins are interconnected by a rod which is parallel to the pivotal axis of the lever, is displaceable within limits in the hinge pins and serves as a pivotal mounting for the coupling member. In a different construction, the extensions of the brake wings are provided with confronting recesses, one such recess in each brake wing and each resembling a tooth gap and receiving a tooth-like end of a rod which is disposed parallel to the pivotal axis of the lever and serves as a pivotal mounting for the coupling member. In either of these cases, a spring can be disposed between the ski and the rod to extend transversely to the latter.

A very simple construction is achieved if the pedal is connected to the wing extensions by the free ends of a coiled bending spring on the pedal, the said ends simultaneously acting as limbs for the spring, the other limb of the spring being formed from its central portion and being supported by the pedal.

The said one lever arm which is actuatable by the pedal can, in the braking position, lie against an elastic abutment limiting its further pivotal motion. In this case, damage or destruction of the brake wings will be practically impossible if the extended brake wings are overstressed by being swung against the direction in which the wings are retracted.

Two examples of the invention will now be described with reference to the accompanying diagrammatic drawings, wherein:-

FIG. 1 is a side elevation of a ski brake secured to a ski;

FIG. 2 is a view of the brake taken in the direction of the arrow II in FIG. 1;

Figure 3:
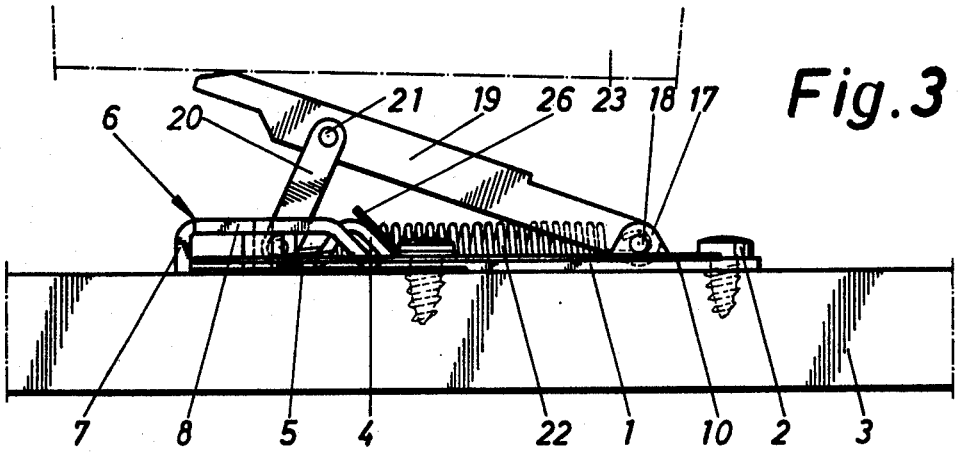
FIG. 3 is a view similar to FIG. 1 but showing the brake in an intermediate condition between an inoperative condition and the fully operative braking condition of FIG. 1.

Referring to FIGS. 1 to 6, the ski brake comprises a base plate 1 secured by screws 2 to the surface of that portion of a ski 3 which will support a ski boot. When viewed in plan (see particularly FIG. 4), the base plate 1 substantially has the shape of a U of which each limb is curved at its free end to form a bearing 4. Secured to the sleeve surface by those of the base plate-securing screws 2 disposed in the limbs of the base plate, there is a thin protecting plate 5 which underlies the base plate and projects beyond it to the left-hand side as viewed in FIG. 1.

Figure 4:
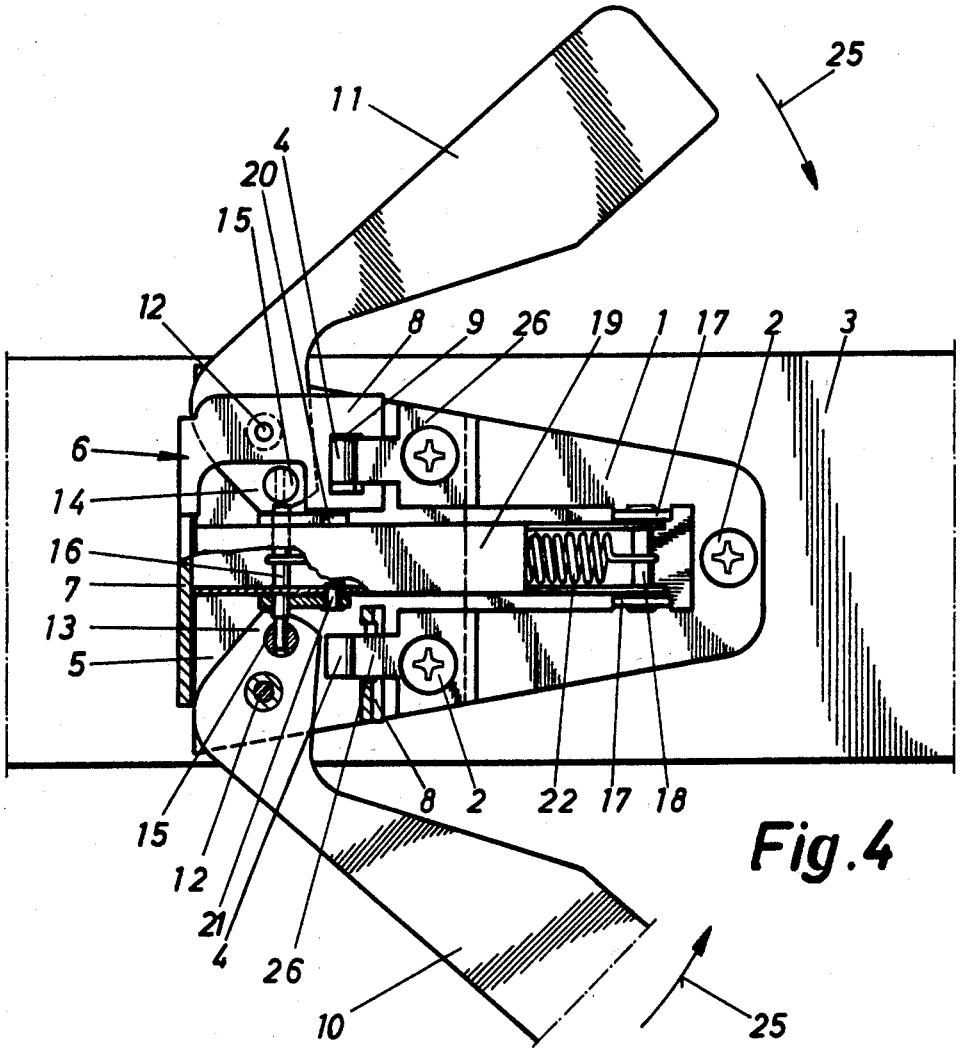
FIG. 4 is a plan view of the brake when in its FIG. 3 condition.

The berings 4 in the limbs of the base plate 1 serve for the pivotal mounting of a lever 6 which is formed as a metal stamping and is likewise substantially U-shaped, as will be evident particularly from FIGS. 2 and 4. The web 7 of the U is flanged downwardly substantially at right-angles whilst the free ends of the limbs 8 are flanged downwardly at approximately 45° and each contains a recess 9 so as to define laterally extending arms that are engaged in the bearings 4 and thereby together constitute a pivot for hinging the lever 6 to the base plate 1 along an axis tht extends transversely to the length of the ski near the surface thereof.

A principal feature of the present invention is the pivotal mounting of brake wings 10, 11 on the lever 6 about a respective pivot 12 in each limb 8. The brake wings are extended beyond the respective pivots 12 so that the extensions are in confronting relationship. Each extension 13, 14 carries a hing pin 15 which is parallel to the pivot 12. The two hinge pins 15 are interconnected by a rod 16 which is parallel to the pivotal axis of the lever 6 with respect to the base plate and which is axially displaceable within limits.

Near its web, each limb of the U-shaped base plate 1 is formed with an upwardly extending lug 17 in which a pivot pin 18 is secured to be parallel to the pivotal axis of the lever 6 with respect to the base plate. A pedal 19 is mounted for pivotal motion on the said pivot pin 18. A coupling member 20 consisting of two congruent links is hinged to the pedal at 21 and to the rod 16. A helical tension spring 22 is engaged between the pivot pin 18 and the rod 16. By means of this spring, the components of the ski brake are biassed to assume the positions shown in FIGS. 1 and 2, in which the ski brake is operative.

Figure 6:
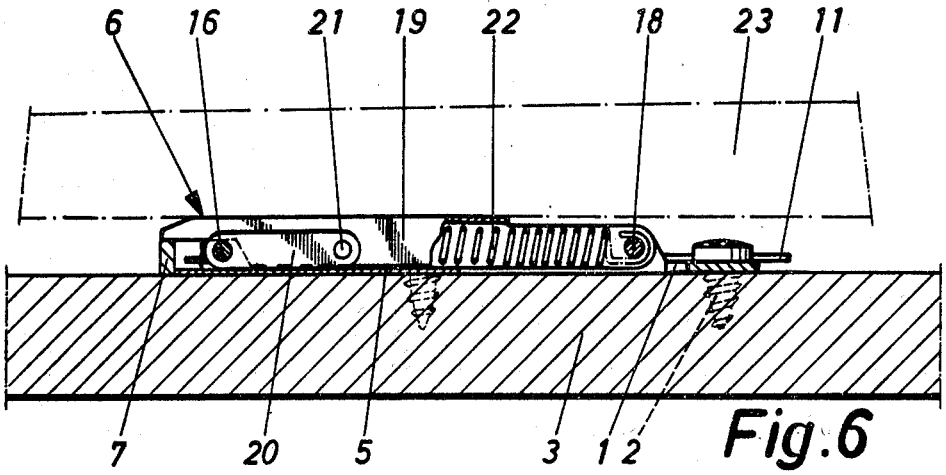
FIG. 6 is a section on the line VI—VI in FIG. 5.
Figure 5:
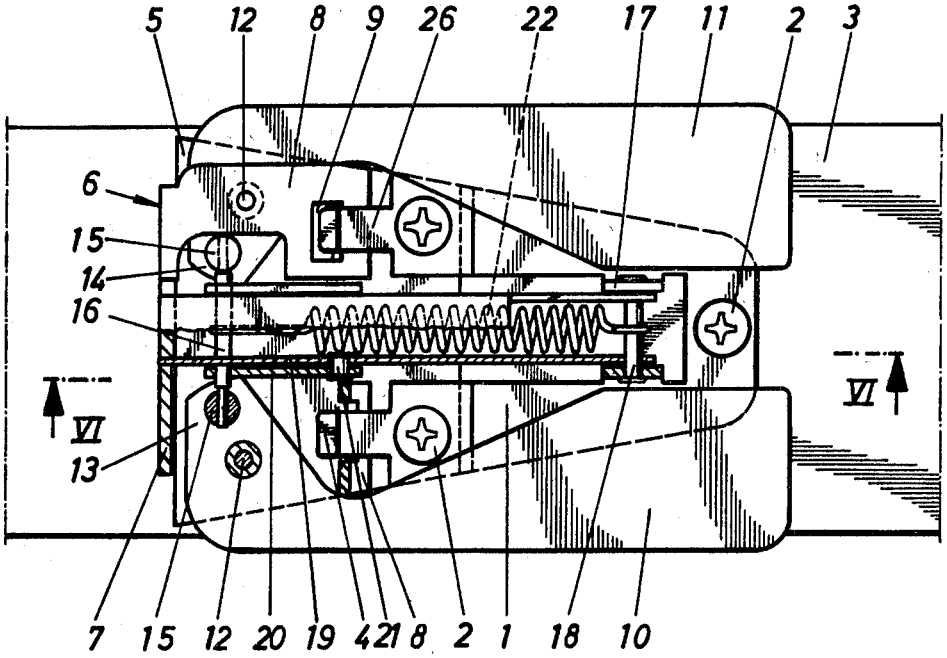
FIG. 5 is a view similar to FIG. 4 but showing the brake in its inoperative condition when the brake wings are fully retracted.

The ski brake is brought to and held in its inoperative condition with the brake wings retracted by introducing the ski boot in the ski binding (not shown). In FIGS. 3 and 6 the sole 23 of the ski boot is shown in chain-dotted lines. The sole depresses the pedal 19, whereby the lever 6 together with the brake wings 10, 11 carried thereby are rotated about the lever pivot in the bearings 4 out of the FIG. 1 position in the direction of the arrow 24 until the flanged web 7 of the lever strikes the surface of the ski 3. The components of the brake are then in the position shown in FIGS. 3 and 4. During this rotation of the lever 6, the rod 16 is moved further away from the pivot pin 18 and consequently rotation of the lever 6 from the FIG. 1 to the FIG. 3 position as caused by depression of the pedal 19 by the ski boot is opposed by the force of the spring 22. From a comparison of FIGS. 2 and 4, it will be evident that, after the first stage of depression of the pedal 19 to swing the lever 6 onto the ski surface, the brake wings 10, 11 will no longer extend in a plane substantially normal to the plane of the ski surface (FIG. 2) but in a plane substantially parallel to the plane of the ski surface (FIG. 4), although both brake wings will still project beyond the sides of the ski. Further depression of the pedal 19 by the sole of the ski boot now causes the brake wings 10, 11 to be retracted in the direction of the arrows 25 in FIG. 4 by being swung about their pivots 12. This is caused by the lower, rod-supporting ends of the two-part coupling member 20 being displaced towards the left-hand side as viewed in FIGS. 3 and 4, whereby the rod 16 engaging in the hinge pins 15 is similarly displaced towards the left-hand side against the action of the spring 22, thereby rotating the wings and stressing the spring 22 even further. The brake is now in its fully inoperative condition as shown in FIGS. 5 and 6. From FIG. 6, it will be evident that the free end of the pedal 19 strikes the web 7 of the U-shaped lever 6 just before the integers 19 and 20 are parallel to one another. The web 7 therefore serves as a stop to ensure tht the spring 22 will always exert a force that tends to bring the brake components back to the FIG. 1 operative position. However, the component of this force directed at right-angles to the ski surface is sufficiently small to avoid any detrimental influence on the safety function of the ski binding in which the ski boot is held.

When the ski boot is removed from the ski (either intentionally or during a fall), the brake will automatically assume its operative position of FIGS. 1 and 2 in so far that the tension spring 22 will first of all displace the rod 16 towards the right-hand side out of the position of FIGS. 5 and 6 to that shown in FIGS. 3 and 4, whereafter the spring will cause the lever 6 and the brake wings 10, 11 carried thereby to be rotated into the FIGS. 1 and 2 position.

If, when the ski boot has been released from the ski, the latter moves to the left as viewed in FIG. 1, and if the brake wings 10, 11 then strike an obstacle, the brake wings will yield resiliently and there is little danger of the wings becoming damaged. To avoid damage in the reverse direction, i.e. when the brake wings hit an obstacle as the ski 3 is moving towards the right as viewed in FIG. 1, provision may be made for the lever 6 and the wings carried thereby to be swung beyond the FIG. 1 braking position in a direction opposite to that of the arrow 24. Such further swinging takes place against the force of two spring plates 26 disposed above the bearings 4 of the base plate 1 and secured together with the latter to the ski 3. In the FIG. 1 braking position and during swinging movement of the lever 6 beyond same, the free ends of the springs plates 26 act against the limbs 8 of the lever 6. By appropriate shaping of the end of the spring 22 engaged on the rod 16, there is sufficient freedom of movement for the rod 16 to be displaced together with the lever 6 against the direction of the arrow 24.

Figure 7:
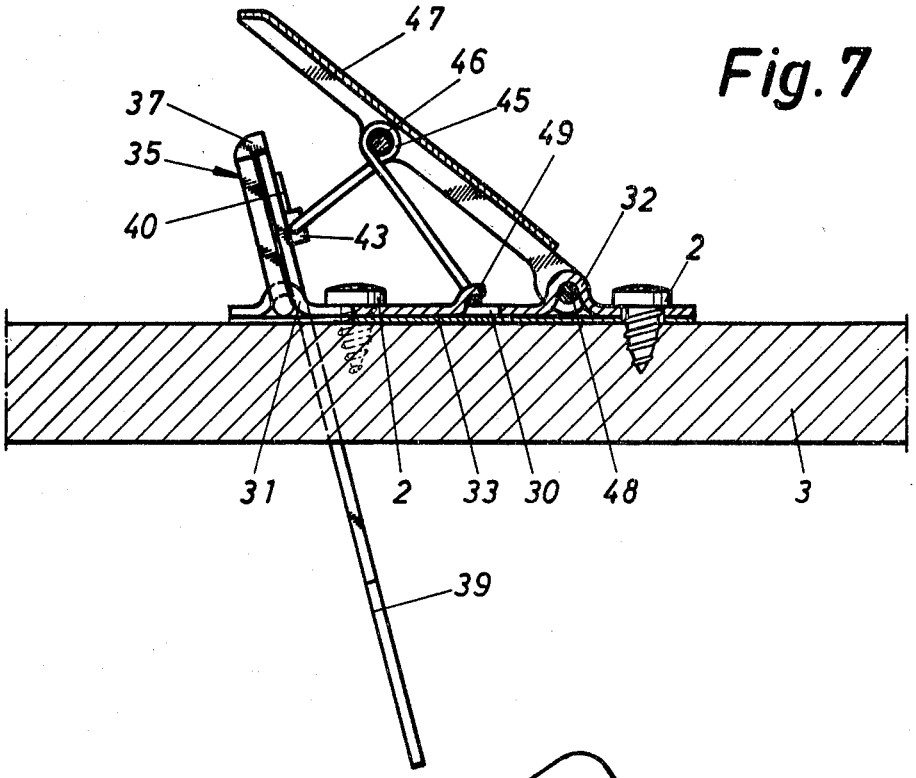
FIG. 7 is a longitudinal sectional side elevation of a second embodiment of ski brake in its operative braking condition.
Figure 8:
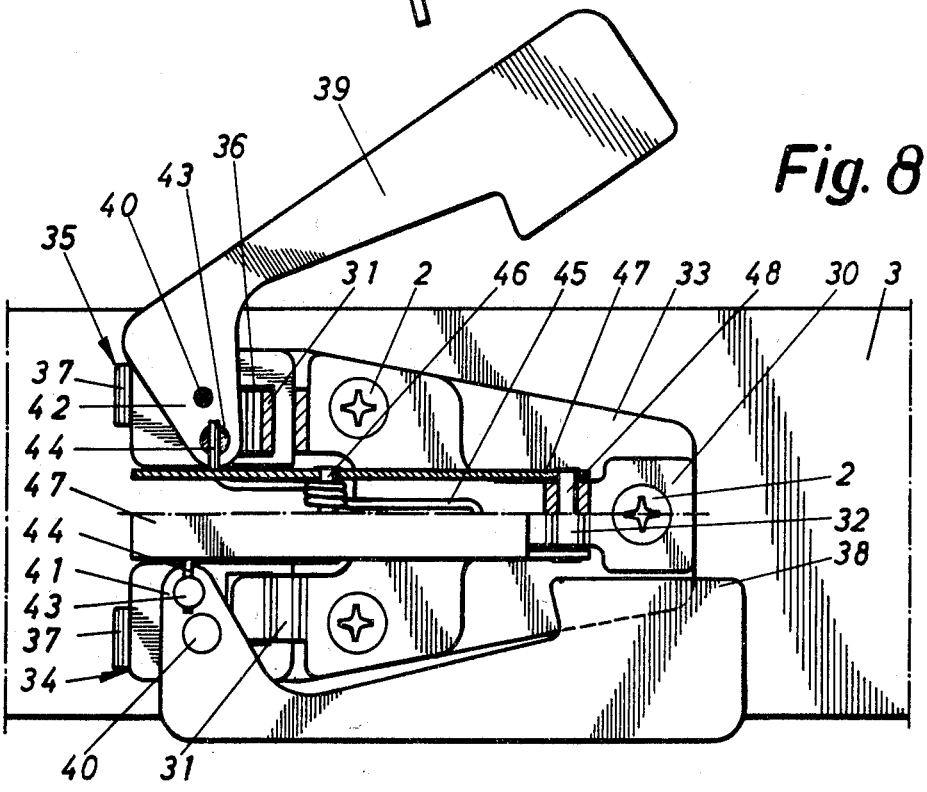
FIG. 8 is a composite plan view of the FIG. 7 brake showing one brake wing in its retracted inoperative position and the other brake wing in an intermediate position between the operative and inoperative positions.

A further embodiment of the invention is illustrated in FIGS. 7 and 8; it corresponds to the previously described embodiment in function but is of simpler construction and lighter in weight. A base plate 30 is again secured to a ski 3 by means of screw 2. In this case, the base plate 30 is substantially T-shaped in plan (see FIG. 8), the limb of the T being shaped to form bearings 31. The leg of the T is also shaped to define a bearing 32. A thin protecting plate 33 is provided to underlie the entire base plate 30,. The protecting plate is secured to the ski by means of the same screws 2 for mounting the base plate and is effective to close the bearings 31, 32 that are formed in the base plate.

In contrast with the lever 6 described in relation to the first embodiment, two levers 34, 35 are here provided. They are coaxially disposed and are a mirror image of one another. Their pivot portions are again defined by a recess 36 and are disposed in the bearings 31. A lug or flange 37 at the end of each lever 34, 35 extends at right-angles thereto to serve as a stop or abutment for the associated brake wing 38, 39 when the brake wings are in their operative braking position as illustrated in the top half of FIG. 8.

The brake wings 38, 39 are rotatably mounted on the levers 34, 35 about a pivot formed by a headed stud 40 extending at right-angles to the respective lever. In this embodiment the brake wings are again extended towards one another beyond the pivots 40. The extensions 41, 42 again each carry a hinge pin 43 extending parallel to the pivot 40. The two hinge pins contain a radial hole above the level of the brake wings to receive the flanged end 44 of a spring wire. This spring wire is coiled to form a bending spring 45 placed over a retaining pin 46 secured in a pedal 47. The central portion of the coiled bending spring forms one of its limbs which is supported against the base plate 30. The two ends of the spring wire act in the same sense as the second limb of the bending spring. The pedal 47 is mounted on the surface of the ski by means of a pivot pin 48 engaged in the bearing 32 of the base plate 30. The pivot pin 48 extends transversely to the length of the ski and the pedal 47 extends parallel to the levers 34, 35.

In principle, the ski brake of FIGS. 7 and 8 functions in the same manner as does the first embodiment. On introduction of a ski boot in its binding (not shown), the levers 34, 35 are swung parallel to the ski during the first stage of depressing the pedal 47. This condition is shown for the lever 35 in the upper half of FIG. 8. Rotation of the pedal takes place against the force of the bending spring 45 because its limbs are being splayed. On further rotation of the pedal 47, further splaying of the limbs of the spring 45 then causes pivotal motion of the brake wings 38, 39 parallel to the surface of the ski to reach their inoperative position, which is shown in the lower half of FIG. 8 for the brake wing 38. The ski brake will automatically return from this inoperative position to the braking position as soon as pressure is removed from the pedal 47. Damage of the brake wings when the latter hit an obstacle on movement of the ski 3 is practically avoided in so far that impacts are absorbed by the bending spring 45. If the impact acts on the brake wings in the normal direction of movement, the limbs of the bending spring are splayed. In the opposite direction, i.e. if the impact is such as to swing the brake wings beyond their normal braking position, the limb of the spring that acts as a coupling between the pedal and the levers is loaded in a direction towards the other limb which, for the purpose of limiting the pivotal motion of the pedal 47 in an upward direction, engages in the braking position behind a hook 49 that is bent out of the base plate 30.

I claim:

1. A ski brake having a lever assembly (6, 10, 11) adapted to be mounted on a top surface of a ski with a pivotal axis disposed in close proximity to the top surface of the ski at least approximately transversely to the length of the ski, said lever assembly including first arm means pivotally connected to said ski about said pivotal axis for carrying (6) second arm means (10, 11), said second arm means comprising two brake wings extending generally longitudinally and having end portions disposed beyond the sides of the ski when the brake is in a braking condition, a pedal adapted for pivotal connection to the ski and (19) operable by a ski boot for actuating and moving the ski brake from the braking condition to an inoperative condition, and spring bias means for moving the brake wings laterally with respect to the ski so that the ski brake automatically assumes its braking condition upon removal of a boot from the pedal, the ski brake being characterised in that pivot connection means pivotally connect each brake wing (10, 11) to the said first arm means (6), the pivot connection means including two pivot pins (12) positioned at right-angles to the said first arm means, and that connection means connect the pedal directly to the brake wings so that, when said first arm means is parallel to the ski surface, movement of the pedal (19) swings the wings relatively to said first arm means to the inoperative condition wherein the two brake wings are disposed above and parallel to the ski surface with their end portions forced towards each other.

2. A ski brake according to claim 1 characterised in that said connection means comprises a coupling member (20) pivotally connected to said pedal (19) (6).

3. A ski brake according to claim 2, characterised in that the coupling member (20) is connected to said first arm means (6) by way of the brake wings (10, 11).

4. A ski brake according to claim 2, characterised in that the said first arm means (6) lies, in the braking condition, against an elastic abutment (26) which limits its further pivotal motion.

5. A ski brake according to claim 2 characterised in that one end of the pedal (19) is adapted to be pivotally mounted on the ski with its pivotal axis parallel to the pivotal axis of said lever assembly.

6. A ski brake according to claim 5, characterised in that a U-shaped base plate (1) is mounted on the top surface of the ski, the free ends of the legs of the base plate defining said pivotal axis of the lever assembly, a rod (18) being held by the connected ends of the base plate with its axis parallel to said pivotal axis, said pedal (19) having one end pivotally connected to said rod.

7. A ski brake according to claim 2 characterised in that the brake wings (10,11) include extending portions that extend towards each other beyond the connection of the wings to the pivot pins (12), the coupling memeber (20) being connected to the extending portions.

8. A ski brake according to claim 7, characterised in that hinge pins 15 are carried by each of the extending portions (13,14) of the brake wings (10,11), the hinge pins (15) being parallel to the pivot pins (12), and in that a rod (16) parallel to the pivotal axis of the lever assembly interconnects said hinge pins, said rod being axially displaceable with respect to said hinge pins and longitudinally displaceable in the plane of said first arm means, one end of said coupling member (20) being pivotally mounted on said rod.

9. A ski brake according to claim 8 wherein said spring bias means includes a spring connected between the ski and the rod (16) extending transversely to the latter.

* * * * *